US009194171B2

(12) United States Patent
Norwood et al.

(10) Patent No.: US 9,194,171 B2
(45) Date of Patent: Nov. 24, 2015

(54) PREFABRICATED FLASHING PRODUCT

(71) Applicant: Norwood Architecture, Inc., Louisville, CO (US)

(72) Inventors: Steven A. Norwood, Louisville, CO (US); Adam Osterhoff, Boulder, CO (US)

(73) Assignee: Norwood Architecture, Inc., Louisville, CO (US)

( * ) Notice: Subject to any disclaimer, the term of this patent is extended or adjusted under 35 U.S.C. 154(b) by 0 days.

(21) Appl. No.: 14/228,590

(22) Filed: Mar. 28, 2014

(65) Prior Publication Data

US 2014/0208682 A1 Jul. 31, 2014

Related U.S. Application Data

(62) Division of application No. 13/572,274, filed on Aug. 10, 2012, now Pat. No. 8,959,842.

(51) Int. Cl.

| | |
|---|---|
| ***E04B 1/66*** | (2006.01) |
| ***E04D 13/00*** | (2006.01) |
| ***E06B 1/68*** | (2006.01) |

(Continued)

(52) U.S. Cl.

CPC ... *E06B 1/68* (2013.01); *E04B 1/66* (2013.01); *E04B 1/665* (2013.01); *E06B 1/62* (2013.01); *E06B 7/14* (2013.01); *E06B 2001/628* (2013.01)

(58) Field of Classification Search

CPC ..... E04D 13/0459; E04D 13/0813; E04D 13/002; E04D 13/00; E04F 13/00; E04F 13/002; E04F 13/07; E04F 13/007; E04B 13/15; E04B 1/66; E04B 1/665; E04B 1/62; E04B 1/7069; E04B 1/70

USPC ..... 52/58, 60–62, 302.3, 302.6, 95–97, 202

See application file for complete search history.

(56) References Cited

U.S. PATENT DOCUMENTS

| | | | |
|---|---|---|---|
| RE24,027 | E | 6/1955 | Bourne et al. |
| 2,822,763 | A | 2/1958 | Berg |
| 2,974,448 | A | 3/1961 | Weis |

(Continued)

FOREIGN PATENT DOCUMENTS

| | | |
|---|---|---|
| CA | 2292301 | 1/2001 |
| WO | 2004055293 A1 | 7/2004 |

OTHER PUBLICATIONS

U.S. Appl. No. 13/572,274 Office Action dated Sep. 18, 2014, 8 pages.

(Continued)

*Primary Examiner* — Phi Dieu Tran A

(74) *Attorney, Agent, or Firm* — Lathrop & Gage LLP

(57) ABSTRACT

A prefabricated flashing product for an opening in an exterior surface of a structure includes a generally planar flange shaped to conform to the exterior surface, the flange extending outwardly from an entire perimeter of an aperture therein that corresponds to the opening, and a return that seals to the flange about the aperture and extends substantially perpendicularly therefrom toward an inward direction of the opening. The flange and the return are monolithically formed of a waterproof material. A method of integrating a fenestration product into an opening of an exterior surface of a structure includes inserting the flashing product described above into the opening, and inserting the fenestration product at least partially into the aperture of the flashing product.

13 Claims, 11 Drawing Sheets

(51) Int. Cl.
*E06B 1/62* (2006.01)
*E06B 7/14* (2006.01)

(56) References Cited

U.S. PATENT DOCUMENTS

| | | | | |
|---|---|---|---|---|
| 3,416,271 | A | 12/1968 | Heeney | |
| 4,543,753 | A | 10/1985 | Sonneborn et al. | |
| 4,621,466 | A | 11/1986 | Sonneborn et al. | |
| 4,694,612 | A | 9/1987 | Pruden et al. | |
| 4,873,803 | A | 10/1989 | Rundo | |
| 4,972,638 | A | 11/1990 | Minter | |
| 5,018,333 | A * | 5/1991 | Bruhm | 52/741.4 |
| 5,065,553 | A | 11/1991 | Magid | |
| 5,586,415 | A | 12/1996 | Fisher et al. | |
| D397,810 | S | 9/1998 | Basset | |
| 5,899,026 | A * | 5/1999 | Williams et al. | 52/58 |
| 5,946,870 | A | 9/1999 | Bifano et al. | |
| 6,212,834 | B1 | 4/2001 | Lindgren | |
| 6,293,064 | B1 | 9/2001 | Larson | |
| 6,305,130 | B1 | 10/2001 | Ackerman, Jr. | |
| 6,385,925 | B1 | 5/2002 | Wark | |
| 6,401,401 | B1 | 6/2002 | Williams | |
| 6,401,402 | B1 | 6/2002 | Williams | |
| 6,457,279 | B1 | 10/2002 | Jacobsen et al. | |
| 6,526,709 | B1 | 3/2003 | Jacobsen | |
| 6,640,508 | B2 | 11/2003 | Lindgren et al. | |
| 6,725,610 | B2 * | 4/2004 | Murphy et al. | 52/58 |
| 7,222,462 | B2 * | 5/2007 | Ellingson | 52/62 |
| 7,331,145 | B2 | 2/2008 | Feucht et al. | |
| 7,591,106 | B2 * | 9/2009 | Conlin | 52/58 |
| 7,673,426 | B2 * | 3/2010 | Broad et al. | 52/204.1 |
| 7,676,996 | B2 * | 3/2010 | Teodorovich | 52/204.2 |
| 7,775,004 | B2 * | 8/2010 | Allen | 52/209 |
| 7,797,884 | B2 * | 9/2010 | Allen | 52/58 |
| 7,874,121 | B1 * | 1/2011 | Hohmann, Jr. | 52/717.01 |
| 7,877,940 | B2 * | 2/2011 | Meeks et al. | 52/212 |
| 7,877,945 | B2 * | 2/2011 | Eggen et al. | 52/302.3 |
| 7,937,900 | B1 * | 5/2011 | Gaffney et al. | 52/200 |
| 8,006,445 | B2 * | 8/2011 | Burton et al. | 52/204.55 |
| 8,065,839 | B2 | 11/2011 | Conlin | |
| 8,387,336 | B2 * | 3/2013 | Coulton et al. | 52/741.4 |
| 8,561,357 | B2 | 10/2013 | Teodorovich | |
| 8,683,695 | B2 | 4/2014 | Rasmussen et al. | |
| 8,959,842 | B2 | 2/2015 | Norwood et al. | |
| 2002/0108326 | A1 | 8/2002 | Ackerman, Jr. | |
| 2003/0056444 | A1 | 3/2003 | Ackerman, Jr. | |
| 2003/0177712 | A1 | 9/2003 | Gatherum | |
| 2004/0163330 | A1 | 8/2004 | Crum | |
| 2005/0144865 | A1 | 7/2005 | Ellingson | |
| 2005/0166471 | A1 | 8/2005 | Allen | |
| 2006/0236618 | A1 | 10/2006 | Williams | |
| 2006/0260216 | A1 | 11/2006 | Bonshor | |
| 2008/0178557 | A1 | 7/2008 | Parsons et al. | |
| 2008/0229676 | A1 | 9/2008 | Allen | |
| 2009/0056241 | A1 | 3/2009 | Koessler et al. | |
| 2010/0139178 | A1 | 6/2010 | Ehrman et al. | |
| 2010/0251643 | A1 | 10/2010 | Rosende et al. | |
| 2011/0047888 | A1 | 3/2011 | Bonshor | |
| 2011/0072747 | A1 | 3/2011 | Tatley et al. | |
| 2012/0144761 | A1 | 6/2012 | Teodorovich | |

OTHER PUBLICATIONS

U.S. Appl. No. 13/572,274 Response filed Oct. 20, 2014, 13 pages.

U.S. Appl. No. 13/572,274 Notice of Allowance filed Oct. 29, 2014, 5 pages.

U.S. Appl. No. 29/429,452 Notice of Allowance dated May 27, 2014, 8 pages.

Quickflash Weatherproofing Products, Home Constructions Equipment, Toxic Mold Prevention: Retrieved from the Internet at http://www.quickflashproducts.com/products_eletrical.html on Jun. 20, 2012.

U.S. Appl. No. 14/628,714 Non-final Office Action dated Apr. 30, 2015, 10 pages.

Chinese Patent Application 201310347255.0 Office Action dated Apr. 29, 2015, 14 pages.

U.S. Appl. No. 14/479,282 Non-final Office Action dated Jul. 16, 2015, 23 pages.

Mexico Patent Application MX/a/2013/009322 Office Action dated Jul. 3, 2015, 2 pages.

* cited by examiner

PREFABRICATED FLASHING PRODUCT

RELATED APPLICATIONS

This application claims priority to, and is a divisional of, U.S. patent application Ser. No. 13/572,274, filed on Aug. 10, 2012 by Norwood et al. and entitled "Prefabricated Flashing Product" and which is incorporated by reference in its entirety herewith.

BACKGROUND

A common failure mode in construction is a failure to form a durable weatherproof assembly at features such as doors and windows installed within openings of exterior surfaces. Various types of flashing products have been developed, some of which use field-applied strips of adhesive backed sheet products. Other products are field-assembled to flash a portion of an opening, typically the sill or bottom of an opening. These other products help to prevent moisture ingress around such features, but are inherently susceptible to failure, or can become susceptible to failure through improper installation.

SUMMARY

In an embodiment, a prefabricated flashing product for an opening in an exterior surface of a structure includes a generally planar flange shaped to conform to the exterior surface, the flange extending outwardly from an entire perimeter of an aperture therein that corresponds to the opening, and a return that seals to the flange about the aperture and extends substantially perpendicularly therefrom toward an inward direction of the opening. The flange and the return are monolithically formed of a waterproof material.

In an embodiment, a method of integrating a fenestration product into an opening of an exterior surface of a structure includes inserting a flashing product into the opening, the flashing product, the product including a generally planar flange shaped to conform to the exterior surface, the flange extending outwardly from an entire perimeter of an aperture therein that corresponds to the opening, and a return that seals to the flange about the aperture and extends substantially perpendicularly therefrom toward an inward direction of the opening. The method also includes inserting the fenestration product at least partially into the aperture of the flashing product.

In an embodiment, a prefabricated flashing product for an opening in an exterior surface of a structure includes a flange shaped to conform to the exterior surface and extending outwardly from a perimeter of the opening, and a return that seals to the flange about the perimeter and extends substantially perpendicularly therefrom toward an interior of the structure. The flange and the return are monolithically formed of a waterproof material.

In an embodiment, a method of integrating a fenestration product into an opening of an exterior surface of a structure includes inserting a monolithic, water proofed flashing product into the opening, such that a flange of the flashing product conforms to the exterior surface and extends outwardly from the opening, and such that a return of the flashing product seals to the flange about an entire perimeter of the opening. The method also includes inserting the fenestration product at least partially into the aperture.

In an embodiment, a method of manufacturing a preflashing product for a structure forming an opening for a fenestration product includes monolithically forming a flange with a return, wherein the flange is planar shaped to conform to an exterior surface of the structure and extends outwardly from an entire perimeter of the opening, and wherein the return seals to the flange about the perimeter and extends substantially perpendicularly therefrom into the direction of the opening.

DETAILED DESCRIPTION OF THE DRAWINGS

Figure 1:
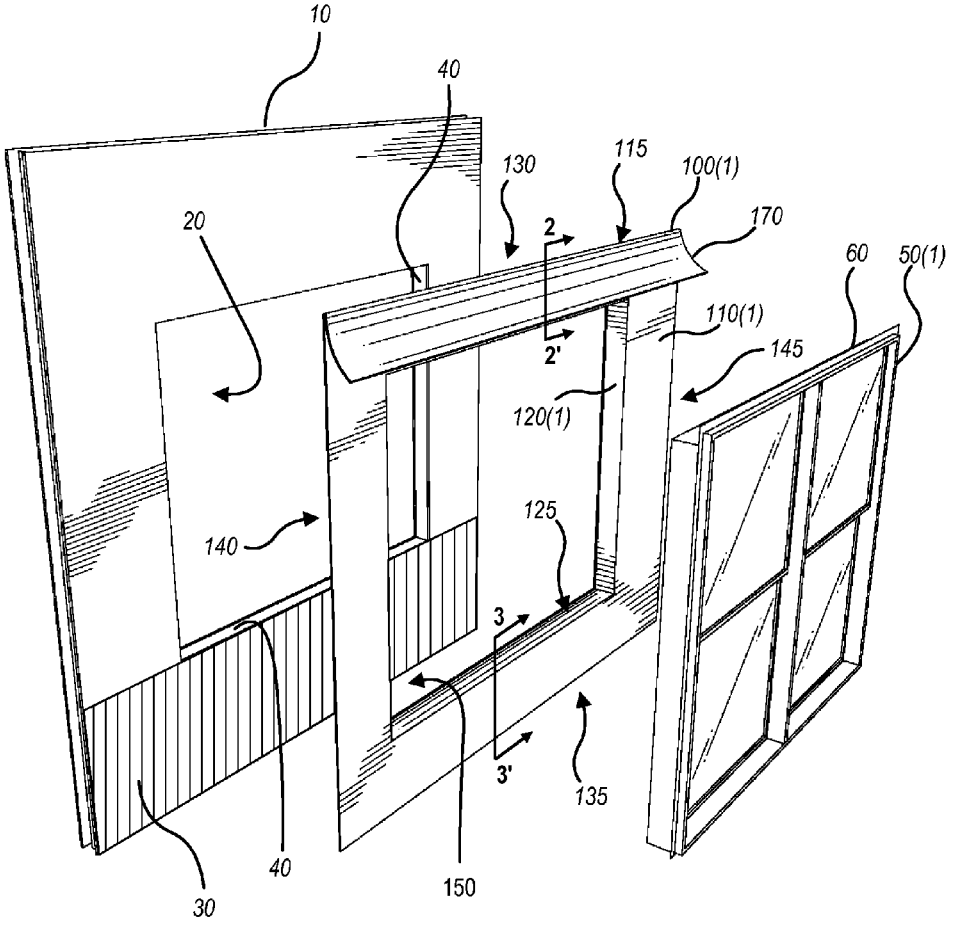
FIG. 1 is an exploded drawing that shows a prefabricated flashing product between a structure that forms an opening, and a window to be installed within the opening, in accord with an embodiment.

The present disclosure may be understood by reference to the following detailed description taken in conjunction with the drawings briefly described below. It is noted that, for purposes of illustrative clarity, certain elements in the drawings may not be drawn to scale. In particular, the thicknesses of many elements shown in certain drawings herein may be exaggerated in comparison to their height and width. Specific instances of an item may be referred to by use of a numeral in parentheses (e.g., flange 110(1), 110(2), etc.) while numerals without parentheses refer to any such item (e.g., flanges 110).

The following terms are utilized throughout the present application with the meanings given here. "Upwardly" and "downwardly" mean against and towards the direction of Earth's gravity respectively; "top" and "bottom" mean structure uppermost and lowermost with respect to Earth's gravity. A "slope" or "sloped" similarly refer to a surface that is not horizontal with respect to Earth's gravity. An "exterior surface" of a structure means a surface that is exposed to the elements (e.g., rain or snow); "outwardly" from such surface means away from the surface towards the elements, while "inwardly" from such surface means the direction through the surface, away from the elements.

Figure 7:
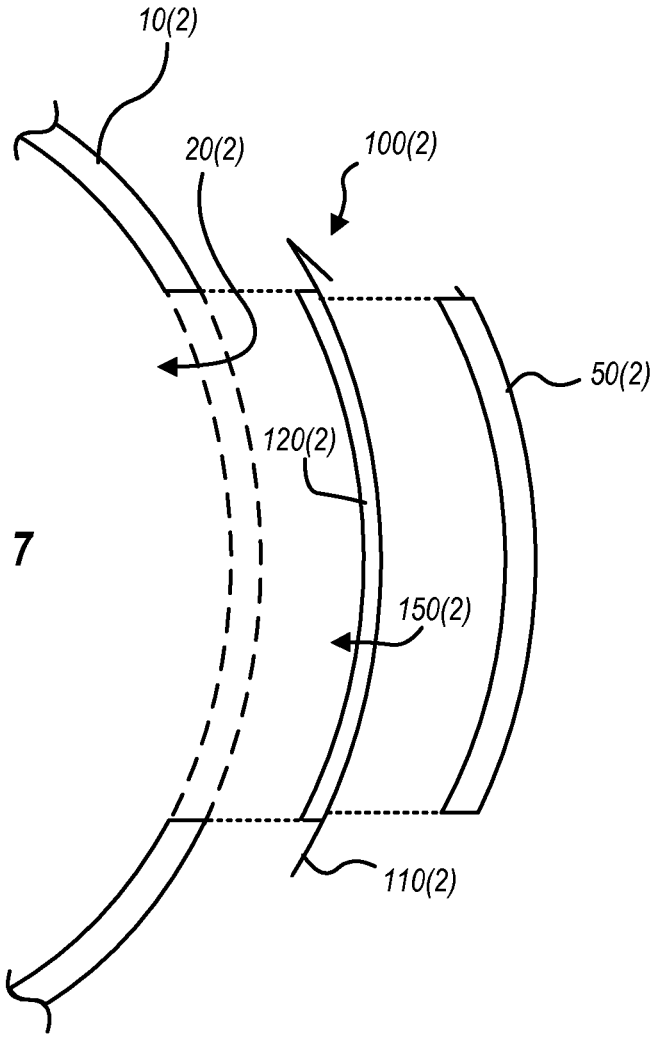
FIG. 7 is a schematic cross-section illustrating a prefabricated flashing product having a curved shape adapted for use with a structure having a curved exterior surface, and with a curved fenestration product, according to an embodiment.

"Outwardly from an aperture" refers to a flat or curved planar shape that extends away from the aperture in all directions, such as flange 110(1) extends from aperture 150 in FIG. 1 and flange 110(2) extends from aperture 150(2) in FIG. 7. "Into the direction of an opening" refers to the direction through an opening in an exterior surface that is from the outside of the surface, through the surface, toward the inside.

Fenestration is an architectural term of art that generally refers to an opening in a surface of a structure. A "fenestration product" as utilized herein is a product that extends through an exterior surface of a structure; framed windows, framed doors and skylights are examples of fenestration products.

FIG. 1 is an exploded drawing that shows a prefabricated flashing product 100(1) between an exterior surface 10 of a structure that forms an opening 20, and a window product 50(1) to be installed within opening 20. It is understood that window product 50(1) is exemplary only, and can be replaced by a different fenestration product. Typically before flashing product 100(1) is installed, a lower weather resistant barrier 30 is installed, but certain embodiments may omit lower weather resistant barrier 30 and install flashing product 100(1) directly on exterior surface 10. Opening 20 is usually surrounded by framing 40, as shown. Flashing product 100(1) includes a flange 110(1) and a return 120(1). Flashing product 100(1) is generally rectangular and has a top member 130, a bottom member 135, and left and right side members 140 and 145, although as discussed later herein, other embodiments of prefabricated flashing products may not be rectangular and accordingly may not have the same arrangement of top, bottom and side members as shown in FIG. 1. Flange 110(1) is planar, is shaped to conform to surface 10, and extends outwardly from an entire perimeter of an aperture 150 formed by flashing product 100(1), as shown.

Flashing product 100(1) is monolithically formed, typically by molding a rubber or plastic into the configuration disclosed herein. Because of its monolithic structure, return 120(1) of product 100(1) seals to flange 110(1) about aperture 150. Return 120(1) extends substantially perpendicularly and inwardly from aperture 150, that is, into the direction of opening 20. Thus, when return 120(1) of product 100(1) inserts into opening 20, flange 110(1) conforms to surface 10, such that if a weather resistant barrier (not shown; see FIG. 11B) is installed over top member 130 and side members 140, 145 after installation of prefabricated flashing product 100(1), product 100(1) will provide continuous flashing everywhere about opening 20 except for aperture 150 within product 100(1). Thus, any moisture that enters around edges of fenestration product 50(1) is still not able to access opening 20, but is diverted by flange 110(1) outwardly from opening 20 where it will likely not be able to continue ingress into the structure. In particular, the monolithic construction of flashing product 100(1) provides the advantage that the flashing product does not present a leakage risk around corners of fenestration products such as window 50(1). As noted above, certain prior art flashing products exist, such as field-applied strips of adhesive backed sheet products, or products that are field-assembled to flash a portion of an opening. Such products are commonly installed in overlapping fashion with one another or with custom corner pieces to form flashing about a window, but the overlap joints can present weaknesses, particularly over time as a structure ages. Embodiments herein avoid this issue, due to their monolithic construction.

Figure 2:
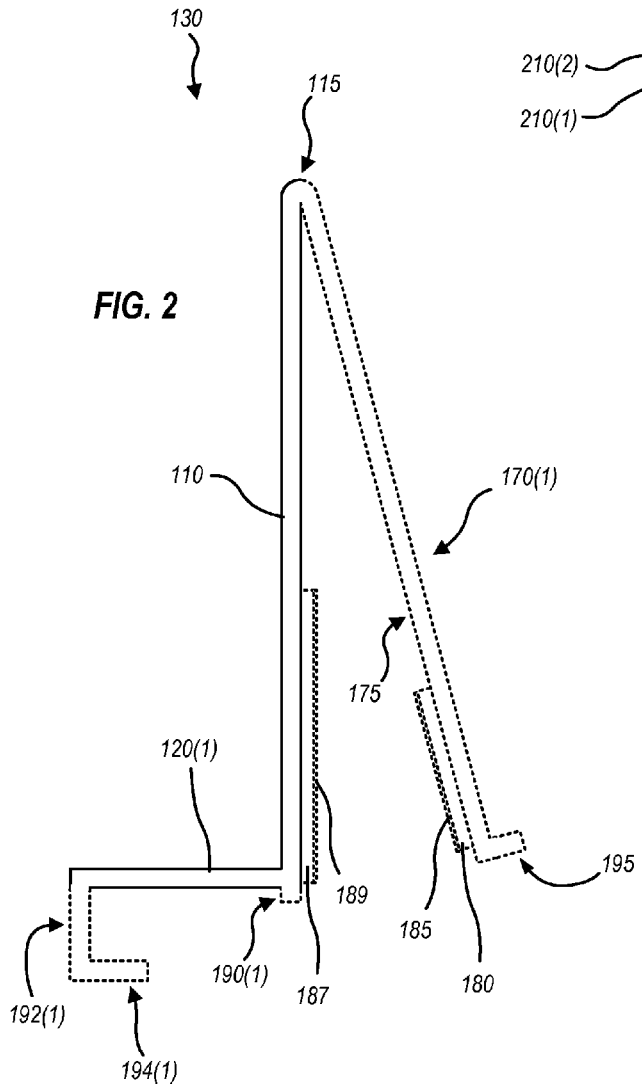
FIG. 2 is a schematic cross-section of a top member of the prefabricated flashing product of FIG. 1, according to an embodiment.

In certain embodiments, a return 120 forms a bottom interior surface 125 that slopes from a distal edge of return 120 (e.g., an edge of return 120 that is furthest from flange 110(1)) towards aperture 150). As shown in FIG. 2, sloping bottom interior surface 125(1) drains water on return 120(1) outwardly through aperture 150; in alternate embodiments, surface 125(1) may be flat (e.g., unsloped). Also, when surface 125 is sloped, return 120 may include ribs (see, e.g., FIG. 3) to form a flat surface for a fenestration product (e.g., window product 50(1)) to rest upon, at least during installation, without interfering with the ability of surface 125(1) to drain water outwardly through aperture 150.

Product 100(1) also includes an optional upper flap 170 that seals to an upper edge 115 of flange 110(1). Upper flap 170 typically folds down from upper edge 115 along a living hinge that may be formed (a) by folding over upper flap 170 along upper edge 115 or (b) at a molded-in indentation at upper edge 115. Upper flap 170 is designed to fold over, and optionally seal to, a nailing fin 60 of window product 50(1), as discussed further below (see, e.g., FIG. 6). Alternative embodiments herein do not include optional upper flap 170 (see, e.g., FIG. 12).

Prefabricated flashing product 100(1) is installed by insertion into an opening in an unfinished exterior surface, insertion of a fenestration product into aperture 150 of product 100(1), and folding optional upper flap 170 over a nailing fin of the fenestration product. Installed in this way, product 100(1) forms a wide, weatherproof boundary around the original opening. A weather resistant barrier (see FIG. 11B) is typically installed over flange 110(1) and upper flap 170. Optional installation steps include sealing flashing product 100(1) to the exterior surface that surrounds opening 20, nailing the flashing product into the exterior surface and/or into framing 40 about opening 20, sealing optional upper flap 170 to the nailing fin and/or to flange 110(1) where it folds over, and nailing upper flap 170 and/or flange 110(1) to the exterior surface. The installation process is disclosed in greater detail below in connection with FIG. 4.

As noted above, a flange 110 and a return 120 (and when present, optional upper flap 170) are monolithically formed of a waterproof material such as plastic or rubber to form product 100. In certain embodiments, a single waterproof material is the only material forming product 100; in alternate embodiments, the waterproof material may be molded about an inner material (e.g., a metal frame) for increased mechanical strength (see, e.g., FIG. 5).

Product 100, including flange 110 and return 120, may be fabricated of a size and thickness that is appropriate for a given installation. In the example of FIG. 1, a typical thickness of flange 110(1) and return 120 is about 30 mils (0.030 inches); in a lightweight version of product 100 this thickness could be as little as 20 mils and in a heavy duty version it could be 100 mils or more. For a typical installation (e.g., for a window that is 2 to 4 feet per side), flange 110(1) extends about 9 inches outwardly in all directions from the window opening. In smaller or larger installations, flange 110(1) may extend outwardly as little as about 4 inches, or as much as 12 inches or more. When present, optional upper flap 170 typically extends from upper edge 115 down to aperture 150, but for certain fenestration products having an exterior surface designed to butt up against the exterior surface, upper flap 170 may be shorter, so as to seal to a nailing fin of the window while lying flat against flange 110(1) (e.g., to avoid upper flap 170 pushing back from the edge of the fenestration product). Return 120 is typically less deep than a corresponding depth of framing used to construct a structure, but deeper than a fenestration product to be installed. For example, when 2×4 inch framing is utilized, return 120 may be about 3 inches deep, and a fenestration product may be about 2.5 inches deep. When 2×6 framing is utilized, return 120 may be about 5 inches deep.

FIG. 2 is a schematic cross-section of top member 130 taken along line 2-2' in FIG. 1. In this embodiment, return 120 is monolithically formed with flange 110(1), as shown. In the embodiment shown in FIG. 2, optional upper flap 170(1) is also monolithically formed with flange 110(1); that is, upper flap 170(1) is molded concurrently with flange 110(1) as an extension thereof. In other embodiments, an upper flap 170 may be formed separately from a flange 110 and sealed thereto along upper edge 115. After flashing product 100(1) is placed in an opening and a fenestration product is installed, upper flap 170(1) folds down along upper edge 115 and optionally seals to a nailing fin of the fenestration product (e.g., nailing fin 60 of window 50(1), FIG. 1 and FIG. 6) using adhesive strips, as now discussed.

FIG. 2 shows an optional adhesive strip 180 disposed along an inner surface 175 of upper flap 170(1). Adhesive strip 180 may be utilized to seal upper flap 170(1) to flange 110(1) and/or to a nailing fin of a window installed therein, as described further below. Adhesive strip 180 may be of any suitable thickness, for example 20 to 50 mils. Adhesive strip 180 may also have any suitable width; in certain embodiments strip 180 may be as wide as an upper flap 170, while in other embodiments it may be only one-half to two inches wide. Adhesive strip 180 may be positioned at the bottom of upper flap 170(1) or slightly above the bottom of upper flap 170(1), as shown in FIG. 2. Adhesive strip 180 may include a self-healing adhesive so that strip 180 can maintain a seal after being penetrated by a fastener (e.g., a nail, staple or screw). In the embodiment shown in FIG. 2, a release paper 185 is also shown. Release paper 185 preserves the adhesion of adhesive strip 180 until product 100(1) is installed, as described further below.

Another optional adhesive strip 187 and associated release paper 189 may also be disposed on flange 110(1), as shown. Adhesive strip 187 may be utilized to seal flange 110(1) to upper flap 170(1) and/or to an inner surface of a nailing fin of a fenestration product installed therein, as described further below. Adhesive strip 187 may also include a self healing adhesive so that strip 187 can maintain a seal after being penetrated by a fastener, (e.g., a nail or screw).

Also shown in FIG. 2 are optional drip margins 190(1) and 195, an optional end dam 192(1) and optional return channel 194(1). Although moisture should not be present along the lower edge of top member 130(1) after installation, optional drip margin 190(1) serves as a backup to keep any liquid moisture that may be present in this area from running back along return 120(1), to further discourage ingress of moisture. Drip margin 190(1), end dam 192(1) and return channel 194(1) are particularly advantageous in installations of fenestration products that lack a nailing fin; for example, see FIG. 13. Drip margin 195 may be exposed to weather and helps to shed moisture thereon further away from the flashed opening than if drip margin 195 is not present.

Figure 3:
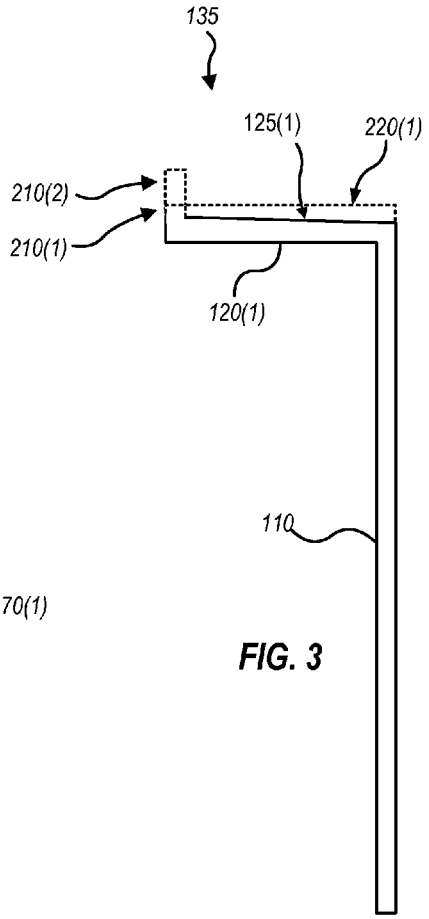
FIG. 3 is a schematic cross-section of a bottom member of the prefabricated flashing product of FIG. 1, according to an embodiment.

FIG. 3 is a schematic cross-section of bottom member 135 taken along line 3-3' in FIG. 1. In the embodiment of this figure, return 120(1) is monolithically formed with flange 110(1), as shown. A bottom interior surface 125 may be flat (unsloped) or may slope towards a flange 110, as bottom interior surface 125(1) is shown, so that any liquid moisture on surface 125(1) is urged towards flange 110(1) (e.g., towards aperture 150, see FIG. 1). An appropriate slope for surface 125(1) is from zero (unsloped) to about 0.25 inch per foot. When interior surface 125(1) surface is sloped, bottom member 135 may include optional ribs 220 that extend upwardly from surface 125(1). Ribs 220 form a flat (unsloped) surface that provides even support for a fenestration product with a flat bottom surface, at least during installation. (A typical installation that utilizes the flashing products described herein attaches the fenestration product to its associated structure utilizing conventional techniques and materials that support the weight of the fenestration product, in addition to the flashing product.) Ribs 220 may be between 0.25 and 1.0 inches wide, with spaces therebetween of 0.25 and 2.0 inches. Alternatively, when an interior surface 125 is flat (unsloped), surface 125 need not include ribs 220. Return 120(1) may also include an optional return stop 210. FIG. 3 shows two possible versions of return stop 210; return stop 210(1) is about 0.25 inch in height above surface 125(1) (that is, about level with optional ribs 220), while return stop 210(2) is about 1 inch in height above surface 125. Return stop 210 blocks liquid moisture that makes its way into return 120(1), from ingress towards the structure.

Figure 4:
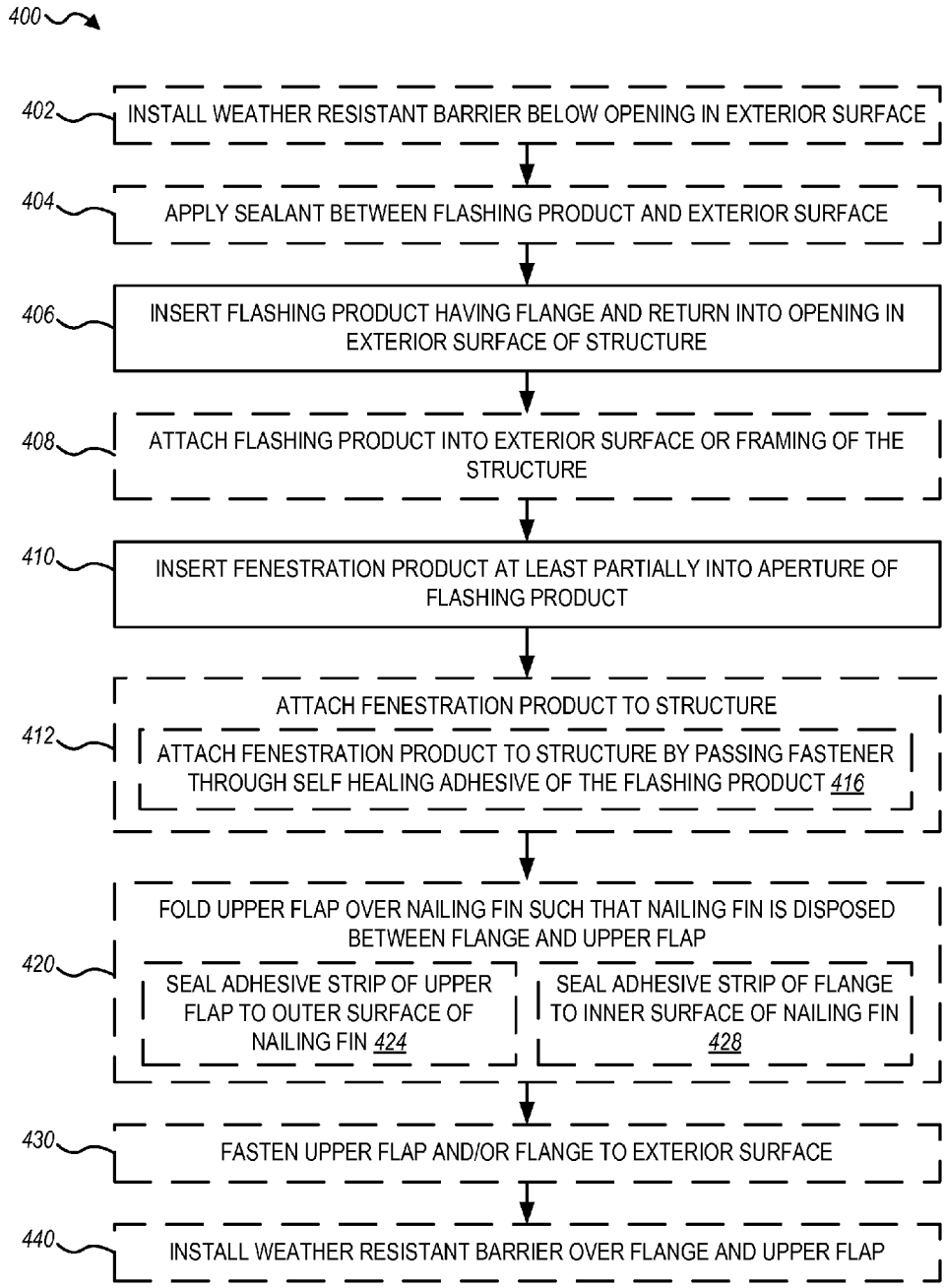
FIG. 4 is a flowchart that schematically illustrates a method of integrating a fenestration product into an opening of an exterior surface of a structure, according to an embodiment.

FIG. 4 is a flowchart that schematically illustrates a method 400 of integrating a fenestration product into an opening of an exterior surface of a structure. Step 402 of method 400 installs a weather resistant barrier below the opening. An example of step 402 is installing weather resistant barrier 30 below opening 20, FIG. 1. An optional step 404 applies a sealant between the flashing product and the exterior surface. An example of step 404 is applying a sealant around opening 20, FIG. 1, or utilizing an adhesive such as adhesive strip 560 on a rearwardly facing surface of flange 110(4), FIG. 9B. Step 406 of method 400 inserts a flashing product having at least a flange and a return into the opening. An example of step 406 is inserting prefabricated flashing product 100(1) into opening 20 of surface 10, FIG. 1. Step 404 may be performed either before or during step 406 (e.g., the flashing product may be inserted partially into the opening as per step 404, a release paper may be removed from adhesive strip 560 as per step 406, and the flashing product may then be fully inserted into the opening to complete step 404). Another optional step 408 attaches the flashing product into the exterior surface or into framing of the structure. Nails are typically utilized in step 408, but other fasteners such as screws may be utilized. An example of step 408 is nailing product 100(1) into framing 40, FIG. 1. Alternatively, step 408 may be omitted, for example when the flashing product matches dimensions of the opening into which it is installed such that the fenestration product and/or its attachment within the opening will be sufficient to hold the flashing product in place.

Step 410 inserts the fenestration product at least partially into the aperture of the flashing product. An example of step 410 is inserting window product 50(1) into flashing product 100(1), FIG. 1. It is appreciated that the fenestration product may not and usually will not be inserted completely into the aperture. For example, a nailing fin or other features of the fenestration product may not be inserted into the flashing product, but may remain outside the aperture (e.g., abutting flange 110, see FIG. 6). Similarly, in certain embodiments the fenestration product may only extend part way into the return of the flashing product (e.g., the fenestration product may be inserted until a rear surface thereof abuts a return stop of the flashing product) while in other embodiments, portions of the fenestration product may extend further into the opening than the flashing product. An optional step 412 attaches the fenestration product to the structure, for example to the exterior surface and/or framing of the structure. Step 412 may or may not involve the flashing product, e.g., a fenestration product might be fastened directly to the exterior surface and/or framing behind return 120. One example of step 412 is nailing nailing fin 60 of window product 50(1) to exterior surface 10 and/or framing 40, FIG. 1. In embodiments, a fenestration product can be attached into the flashing product, exterior surface and/or framing in other ways, for example with fasteners penetrating through the flashing product. The flashing product may be manufactured for a particular fenestration product that is associated with other attachment methods in which a fastener penetrates the flashing product. In such case, the flashing product may be formed with self-healing adhesive in appropriate locations so that when the attachment method penetrates the flashing product, the self healing adhesive seals about the fastener. An optional step 416 is a special case of step 412 wherein the fenestration product attaches to the structure by passing a fastener through the flashing product, with self-healing adhesive sealing about the fastener.

Figure 11A:
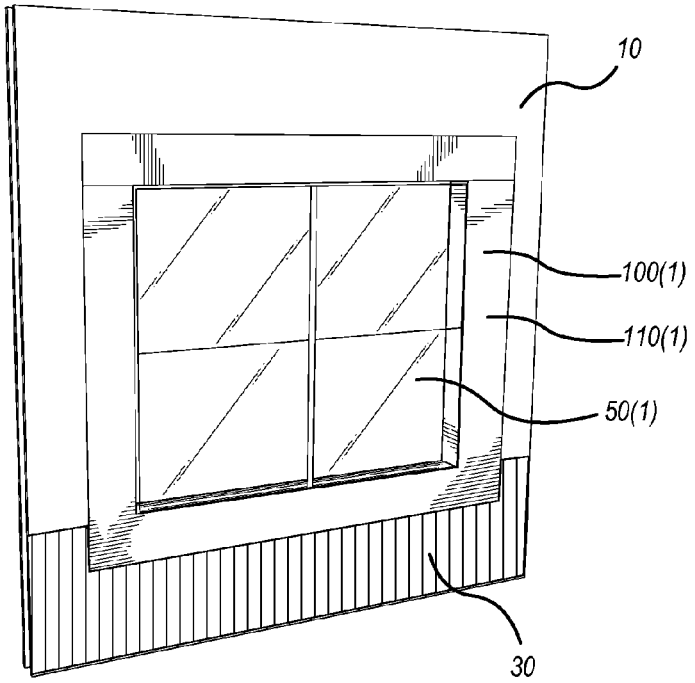
FIGS. 11A and 11B schematically illustrate construction steps following installation of the prefabricated flashing product of FIG. 1, according to an embodiment.
Figure 11B:
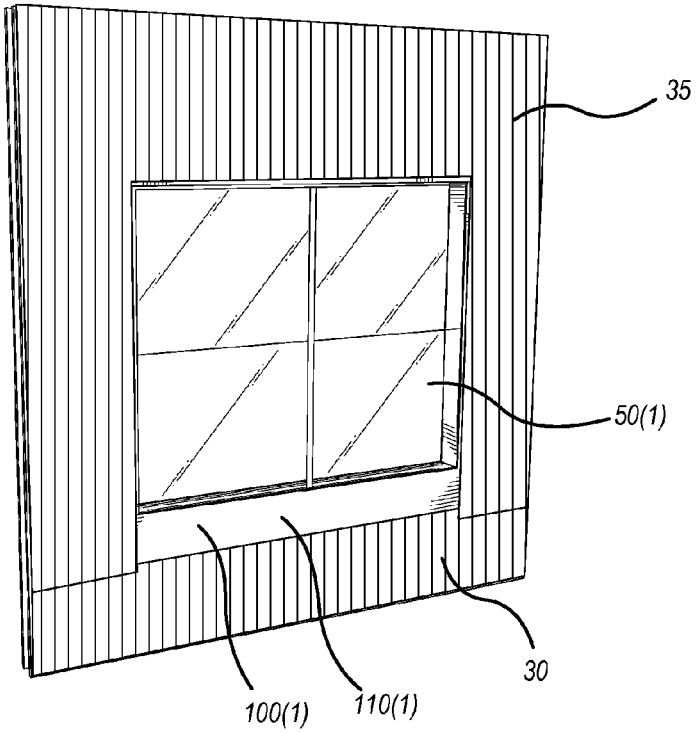

When the fenestration product includes a nailing fin and the flashing product includes an upper flap, another optional step 420 folds the upper flap over the nailing fin such that the nailing fin is disposed between the flange and the upper flap. An example of step 420 is folding upper flap 170 over nailing fin 60 such that nailing fin 60 is disposed between flange 110(1) and upper flap 170, FIG. 1 and FIG. 6. Step 420 may include an optional step 424 of sealing an adhesive strip of the upper flap to an outer surface of the nailing fin. An example of step 424 is sealing adhesive strip 180 to an outer surface of nailing fin 60, FIG. 6. Step 420 may also include an optional step 428 of sealing an adhesive strip of the flange to an inner surface of the nailing fin. An example of step 428 is sealing adhesive strip 187 to an inner surface of nailing fin 60, FIG. 6. Another optional step 430 fastens the upper flap and/or the flange to the exterior surface. An example of step 430 is nailing upper flap 170 and/or flange 110(1) to exterior surface 10, FIG. 1 and FIG. 6. Similar to step 416, step 430 can include penetrating the upper flap and/or flange with a fastener, and a self-healing adhesive can be utilized so that the adhesive seals around the fastener. Another optional step 440 installs a weather resistant barrier over the flange and upper flap. An example of step 440 is installing upper weather resistant barrier 35 over flange 110 and upper flap 170, as shown in FIGS. 11A and 11B.

Figure 5:
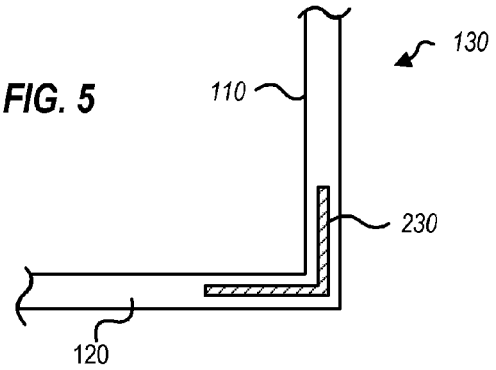
FIG. 5 is a schematic cross-section of a portion of a top member of the prefabricated flashing product of FIG. 1, showing how the flashing product can be molded about an optional reinforcing member, according to an embodiment.

FIG. 5 is a schematic cross-section of a portion of top member 130 showing how a flashing product 100 can be molded about an optional reinforcing member 230. Reinforcing member 230 can be made of any relatively rigid material, such as metal or fiberglass. Reinforcing member 230 typically need not be strong enough to lend significant support as compared to framing of a structure or a window to be mounted therein, but additional rigidity of product 100 due to incorporation of member 230 can be helpful during manufacturing, transport and installation of product 100. For example, the rigidity of product 100 may help hold product 100 in place for easier manipulation of product 100 relative to the structure and fenestration product that it is utilized with, as opposed to a plastic or rubber flashing product 100 that may tend to sag where unsupported.

Figure 6:
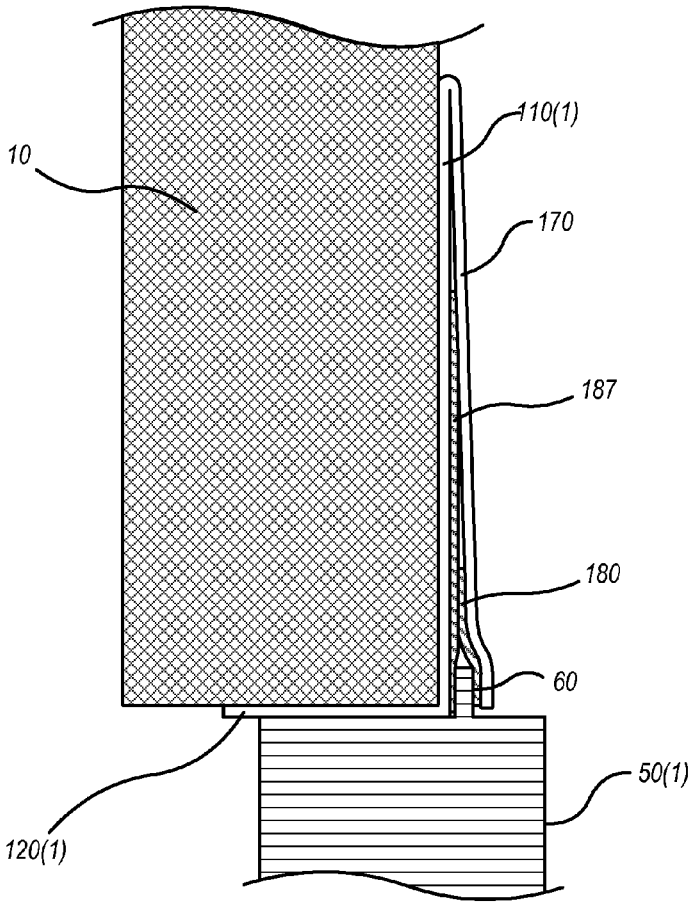
FIG. 6 is a schematic cross-section illustrating the arrangements of an exterior surface, a top member of the prefabricated flashing product of FIG. 1, and a window product after installation, according to an embodiment.

FIG. 6 is a schematic cross-section illustrating the arrangements of surface 10, top member 130 of flashing product 100(1), and window product 50(1) after installation. A portion each of surface 10 and window product 50(1) are schematically shown. Return 120(1) of top member 130 is disposed between surface 10 and window product 50(1). Flange 110(1) is disposed adjacent to surface 10, and upper flap 170 folds down from flange 110(1) at upper edge 115. Upper flap 170 folds over nailing fin 60 of window product 50(1) such that nailing fin 60 is between upper flap 170 and flange 110 (1). Adhesive strip 187 seals to both an inner surface of nailing fin 60 and upper flap 170, and adhesive strip 180 seals to both an outer surface of nailing fin 60 and adhesive strip 187.

It should be apparent that prefabricated flashing product 100 may be utilized in structures intended to provide protection from weather, such as houses, retail, office, industrial or agricultural buildings, and/or vehicles, such as automobiles, trucks, trains, trailers, ships and boats. Certain of these structures may include windows, doors, skylights or other fenestrations that need to maintain weather resistance over curved surfaces. FIG. 7 is a schematic cross-section illustrating a prefabricated flashing product 100(2) having a curved shape adapted for use with a structure having a curved exterior surface 10(2), and with a curved fenestration product 50(2). Exterior surface 10(2) of a structure forms opening 20(2), and a flange 110(2) of product 100(2) is shaped to conform to exterior surface 10(2), as shown. Return 120(2) is shaped to fit within opening 20(2), and product 100(2) forms an aperture 150(2) that accepts fenestration product 50(2). In all respects other than the curved surface and window that it is adapted to, installation and performance of product 100(2) is the same as that of product 100(1) described above. Although FIG. 7 shows an outwardly curved fenestration product, embodiments herein may be adapted for use with inwardly curved fenestration products as well.

Figure 8:
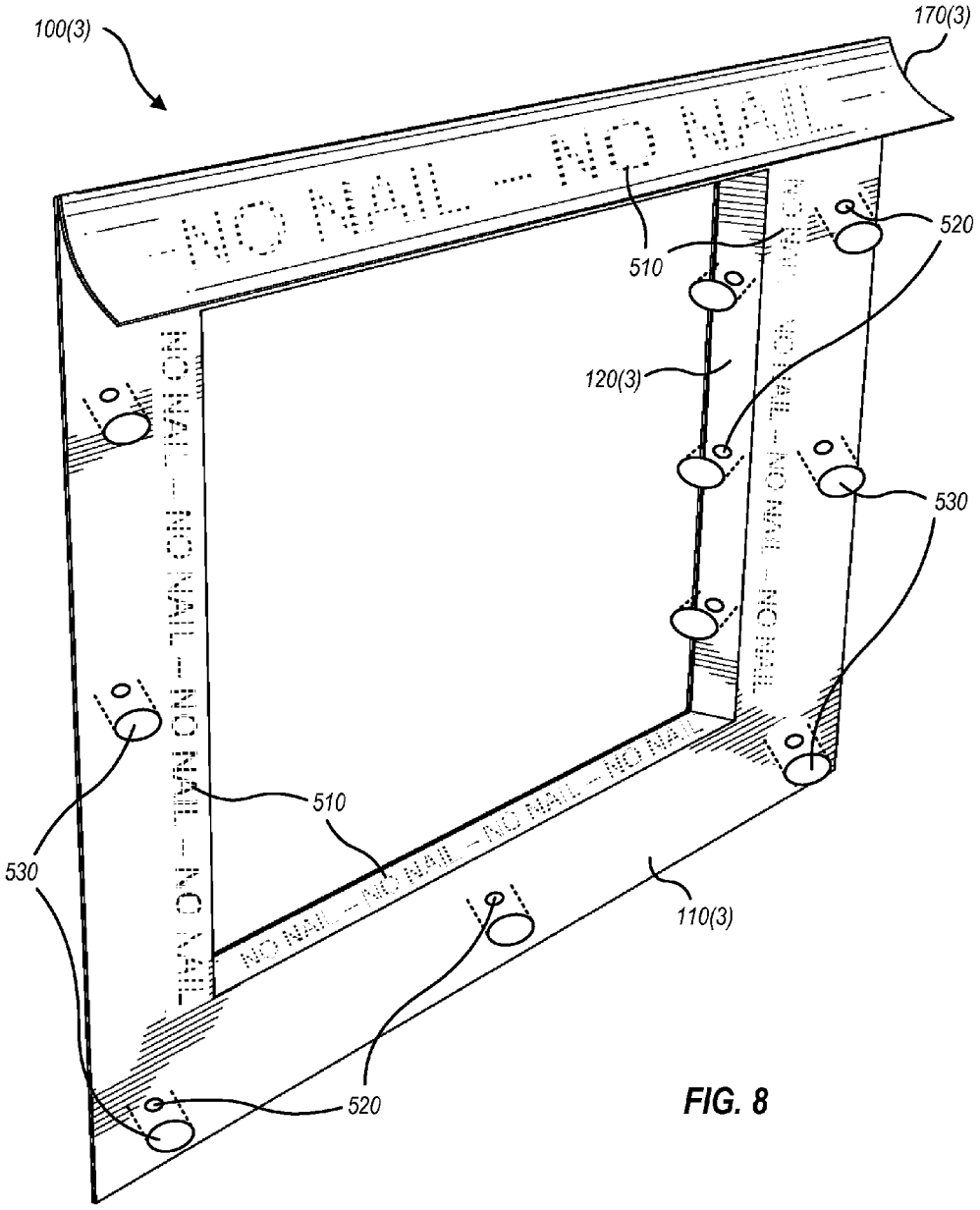
FIG. 8 schematically shows a prefabricated flashing product with several locations marked with indicia, according to an embodiment.

In certain embodiments, a prefabricated flashing product may include indicia thereon to guide installers about installation and in particular, sites on the product where nail holes are to be avoided, to maintain weatherproof integrity of the product. FIG. 8 schematically shows a prefabricated flashing product 100(3) with several locations 510 marked with "NO NAIL" to indicate places where installers should not nail or otherwise perforate flashing product 100(3). Flange 110(3), upper flap 170(3) and return 120(3) correspond to the like numbered elements in FIGS. 1-3 and 5-7. Indicia forbidding perforation (e.g., "NO NAIL") may correspond with portions of flange 110(3) and/or upper flap 170(3) that do not have a self-healing adhesive in place that would seal any nail holes or other perforations. Product 100(3) also includes several predrilled locations 520 to suggest places where installers can or should utilize nails or other fasteners during installation. When prefabricated flashing product 100(3) includes predrilled locations 520, installation instructions may include instructions that such holes must be sealed before the installation is complete (e.g., by caulking, or by applying an adhesive patch 530 over the locations, as shown). Not all predrilled locations 520 or adhesive patches 530 are labeled in FIG. 8, for clarity of illustration.

Figure 9A:
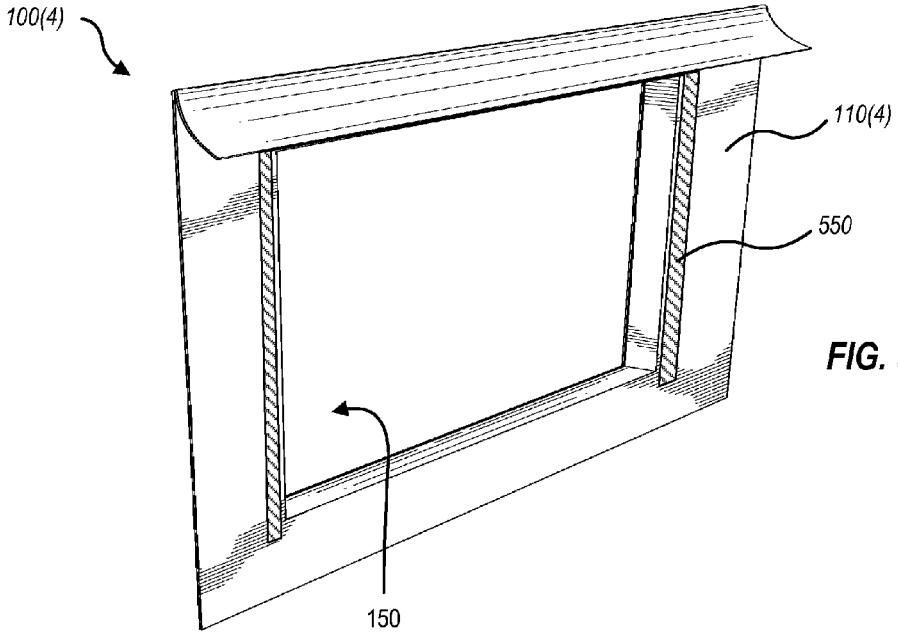
FIG. 9A and FIG. 9B are front and rear perspective views, respectively, of a prefabricated flashing product showing adhesive strips in additional locations, to facilitate further sealing of the flashing product to an exterior surface underneath and a building product installed therein, according to embodiments.
Figure 9B:
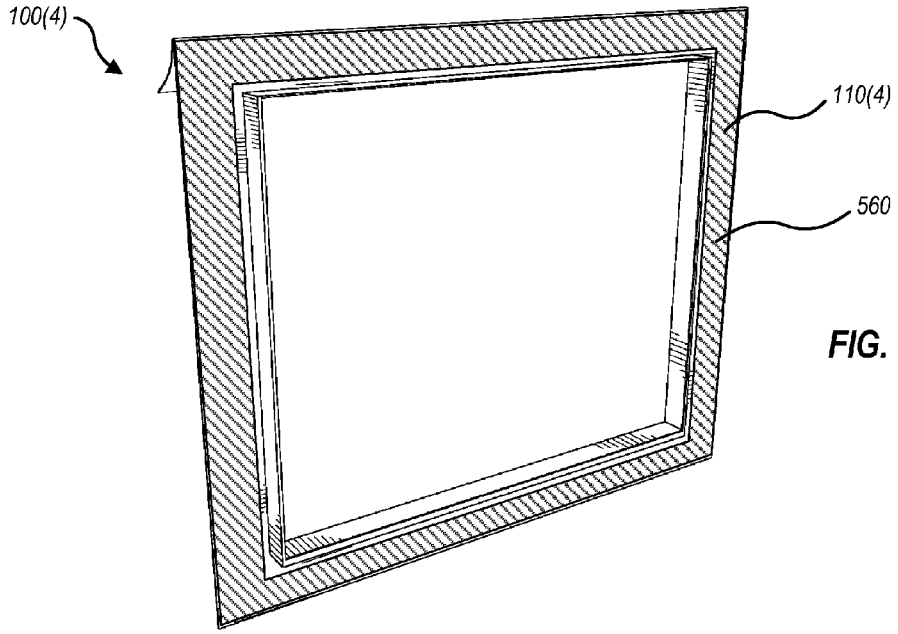

FIG. 9A and FIG. 9B are front and rear perspective views, respectively, of a prefabricated flashing product 100(4) showing optional adhesive strips in additional locations, to facilitate further sealing of product 100(4) to an exterior surface underneath and a building product installed therein. FIG. 9A shows an optional adhesive strip 550 located on flange 110 (4), just outside aperture 150 to the top and sides thereof. Certain building products are supplied with a flange intended to butt up against an opening in which the product is installed. Sealant is sometimes applied around a backside of such flanges, to provide additional weather resistance. Adhesive strip 550 can take the place of the sealant that would have been used. Adhesive strip 550 may be supplied with a release paper in place to preserve its adhesion until product 100(4) is installed. Adhesive strip 550 does not continue along the bottom side of aperture 150, so that any liquid moisture in that area can drain outwardly from aperture 150. FIG. 9B shows an optional adhesive strip 560 substantially covering an entire rear surface of flange 110(4). Adhesive strip 560 can seal flange 110(4) directly to an exterior surface such that any moisture that penetrates behind a weather resistant barrier over flange 110(4) will not be able to proceed to an opening in the exterior surface in which product 100(4) mounts. Of course, adhesive strip 560 can also be supplied with a release paper in place to preserve its adhesion until product 100(4) is installed. Either or adhesive strips 550, 560 may include a self-healing adhesive that can seal around a fastener driven through it, such as a fastener utilized to fasten flashing product 100(4) to a structure or utilized to fasten a fenestration product, through flashing product 100(4), to a structure. In alternative embodiments, adhesive strips 550 and 560 are not provided; in such cases a flashing product can be installed without adhesive seals in the corresponding locations, or sealing can be done during installation by utilizing conventional sealants.

Figure 10:
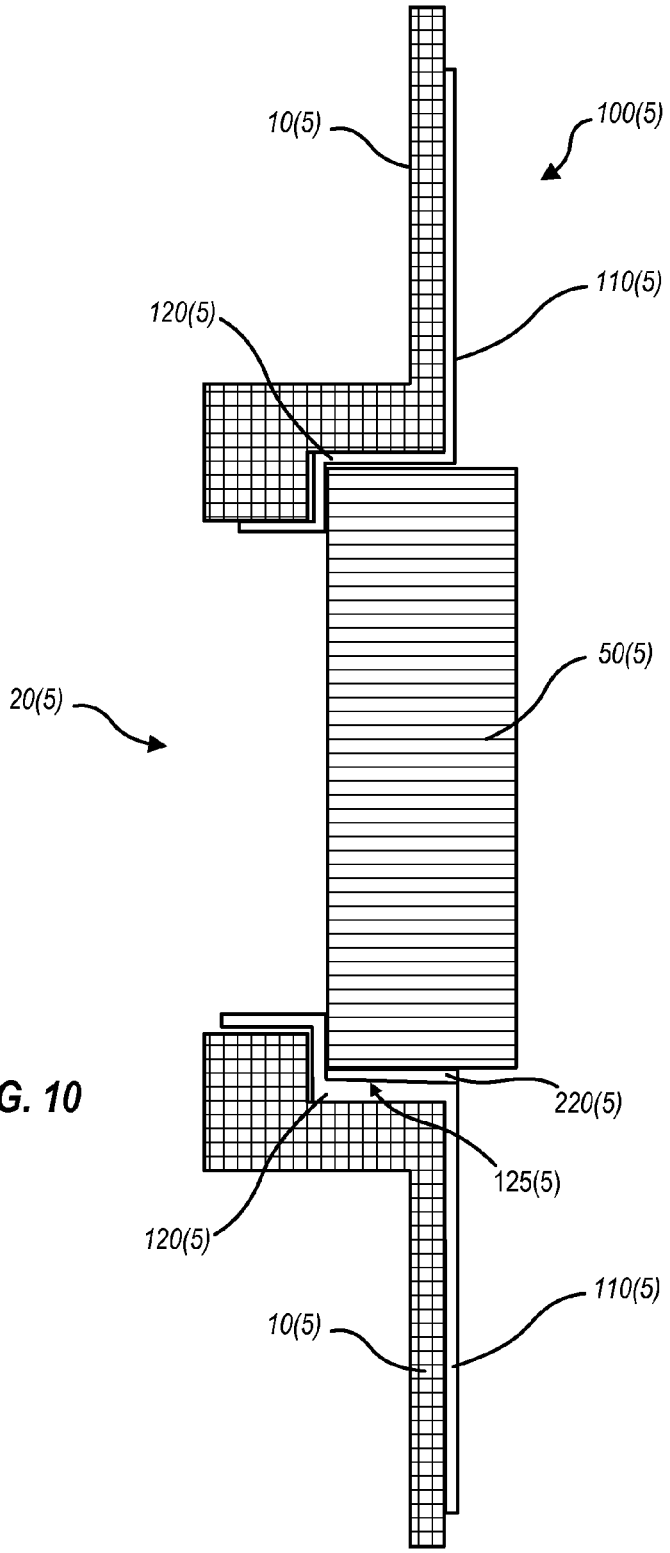
FIG. 10 is a schematic cross section that illustrates an exterior surface having an opening that expands stepwise in the vertical direction, and a prefabricated flashing product that can be utilized with such an opening, according to an embodiment.

The prefabricated flashing product described herein can be adapted to a variety of common architectural approaches to defining and framing features that penetrate an exterior surface of a structure, such as windows. One such variation is a stepped frame in which an opening in the structure is of a given size at one point in the exterior surface, and expands stepwise to a slightly larger size at the exterior surface. The stepwise expansion of the opening may be in the horizontal or vertical directions or both. FIG. 10 is a schematic cross section that illustrates an exterior surface 10(5) having an opening 20(5) that expands stepwise in the vertical direction, and a prefabricated flashing product 100(5) that can be utilized with such an opening. Return 120(5) of flashing product 100(5) includes steps that follow the steps in opening 20(5), as shown. A bottom interior surface 125(5) slopes towards flange 110(5). Stepped fenestration product 50(5) is disposed on ribs 220(5) that provide an unsloped surface. One skilled in the art will appreciate that prefabricated flashing products can be modified similarly to the way flashing product 100(5) follows the steps in opening 20(5), to provide similar flashing performance for a variety of openings in structures.

FIGS. 11A and 11B schematically illustrate construction steps following installation of prefabricated flashing product 100. Flashing product 100(1) and window product 50(1), FIG. 1, are utilized as an example in FIGS. 11A and 11B; but it should be apparent that the techniques described here can be adapted to other embodiments of flashing product 100 and other fenestration products. FIG. 11A shows the same features as in the exploded view of FIG. 1, but with flashing product 100(1) and window product 50(1) installed on exterior surface 10. If lower weather resistant barrier 30 is utilized at all, it is installed first on exterior surface 10, followed by flashing product 100(1), to achieve the overlap of flashing product 100(1) over barrier 30, as shown in FIG. 11A. This is followed by installing window product 50(1), and optionally sealing window product 50(1) into flashing product 100(1) (e.g., by folding down upper flap 170, FIG. 1). FIG. 11B shows the addition of upper weather resistant barrier 35, which covers the top, left and right side members of flashing product 100(1) (e.g., members 130, 140 and 145, FIG. 1). Upper weather resistant barrier 35 can be sealed to window product 50(1), while flashing product 100(1) is unbroken around the periphery of window product 50(1). Thus, flashing product 100(1) does not have lapping or other joints in corners that can compromise the weather resistance of product 100(1).

Figure 12:
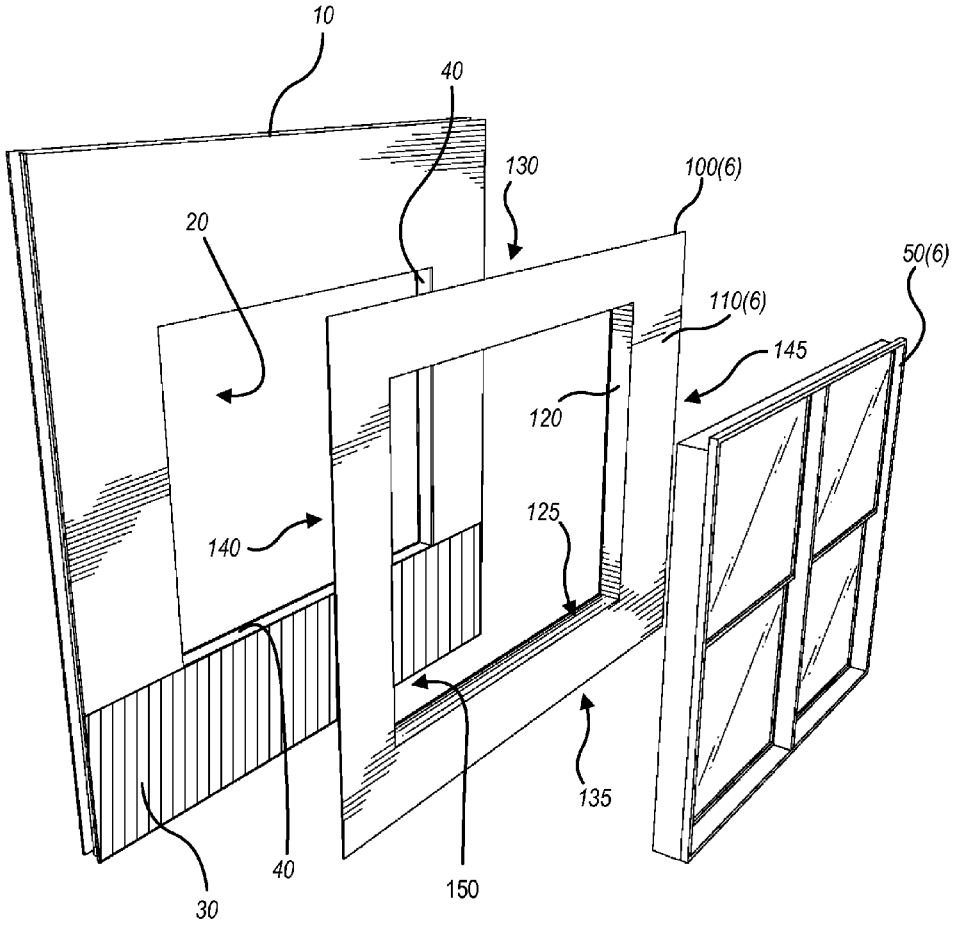
FIG. 12 is an exploded drawing that shows a prefabricated flashing product between an exterior surface of a structure that forms an opening, and a window product to be installed within the opening.

FIG. 12 is an exploded drawing that shows a prefabricated flashing product 100(6) between exterior surface 10 of a structure that forms an opening 20 (e.g., the same surface 10 and opening 20 as shown in FIG. 1), and a window product 50(6) to be installed within opening 20. Window product 50(6) does not include a nailing fin, and correspondingly flashing product 100(6) does not include an upper flap. Although FIG. 12 shows a rectangular flashing product 100 (6) for rectangular opening 20, like flashing products may be adapted to openings of different shapes, such as for example curved or circular openings.

Figure 13:
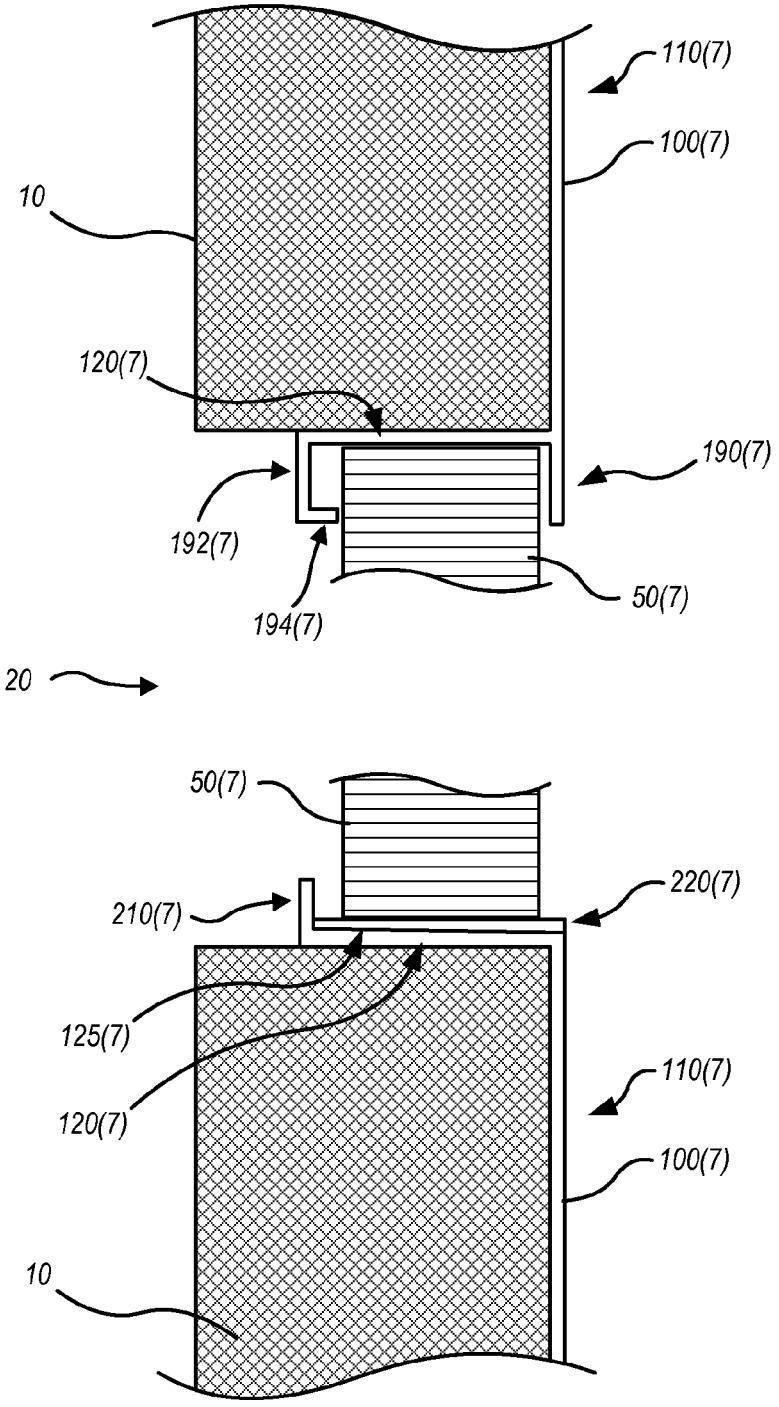
FIG. 13 is a schematic cross-sectional drawing of a prefabricated flashing product installed with a fenestration product that lacks a nailing fin, within an opening of a structure.

FIG. 13 is a schematic cross-sectional drawing of a prefabricated flashing product 100(7) installed with a fenestration product 50(7) that lacks a nailing fin, within opening 20 of exterior surface 10. Portions of surface 10, flashing product 100(7) and fenestration product 50(7) are cut away to show the features of flashing product 100(7) more clearly. Flashing product 100(7) includes a flange 110(7) and a return 120(7), as shown. A top member of flashing product 100(7) includes a drip margin 190(7) below and adjoining flange 110(7) at a proximal edge of return 120(7), and an end dam 192(7) and a return channel 194(7) formed below and adjoining a distal edge of return 120(7), as shown. A bottom member of flashing product 100(7) includes ribs 220(7) that support fenestration product 50(7) at least during installation, and a return stop 210(7). Drip margin 190(7) helps to divert liquid moisture downwards past the top edge of fenestration product 50(7). Moisture that does pass over the top edge of fenestration product 50(7) is blocked from the interior of surface 10 by end dam 192(7), and drains to return channel 194(7). Return channel 194(7) carries such liquid moisture to sides of flashing product 100(7) (not shown in the cross sectional plane of FIG. 13) where it drains to bottom interior surface 125(7) of return 120(7). Surface 125(7) is sloped to urge liquid moisture outwardly from the front of fenestration product 50(7). Flashing product 100(7) includes ribs 220(7) that support fenestration product 50(7) at least during installation, due to the slope of bottom interior surface 125(7).

Changes may be made in the prefabricated flashing products described herein without departing from the scope hereof. It should thus be noted that the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall there between.

What is claimed is:

1. A method of integrating a fenestration product into an opening of an exterior surface of a structure, comprising:

inserting a flashing product into the opening, the flashing product comprising a generally planar flange shaped to conform to the exterior surface, the flange extending outwardly from an entire perimeter of an aperture therein that corresponds to the opening, a return that seals to the flange about the entire perimeter of the aperture and extends substantially perpendicularly therefrom, the flange and the return being monolithically formed of a waterproof material, and an upper flap that seals to an upper edge of the flange via a living hinge such that the upper flap, the flange, and the return are all monolithic;

inserting the fenestration product at least partially into the aperture, and folding the upper flap over a portion of the fenestration product such that the portion is disposed between the flange and the upper flap.

2. The method of claim 1, wherein inserting the fenestration product into the return comprises positioning the fenestration product such that the portion is a nailing fin of the fenestration product abuts the flange, and further comprising folding the upper flap over the nailing fin such that the nailing fin is disposed between the flange and the upper flap.

3. The method of claim 2, further comprising at least one of:

sealing an adhesive strip of the upper flap to an outer surface of the nailing fin, and sealing an adhesive strip of the flange to an inner surface of the nailing fin.

4. The method of claim 1, further comprising:

attaching the fenestration product into one of the exterior surface and framing surrounding the opening by passing a fastener through self healing adhesive of the flashing product.

5. The method of claim 1, further comprising applying a sealant between the flashing product and the exterior surface.

6. The method of claim 1, further comprising at least one of installing a weather resistant barrier on the exterior surface below the opening before the step of inserting the flashing product, and installing a weather resistant barrier over the flange after the step of inserting the fenestration product.

7. A method of integrating a fenestration product into an opening of an exterior surface of a structure, comprising:

inserting a monolithic, water proofed flashing product into the opening, such that a flange of the flashing product conforms to the exterior surface and extends outwardly from the opening, and such that a return of the flashing product seals to the flange about an entire perimeter of the opening, and inserting the fenestration product at least partially into the aperture, and folding an upper flap of the flashing product over a portion of the fenestration product;

wherein the upper flap is connected to the flange via a living hinge such that the upper flap, the flange, and the return are monolithic.

8. The method of claim 1, further comprising sealing an adhesive strip of the upper flap to an outer surface of the portion.

9. The method of claim 8, further comprising sealing an adhesive strip of the flange to an inner surface of the portion.

10. The method of claim 1, further comprising sealing an adhesive strip of the flange to an inner surface of the portion.

11. The method of claim 7, further comprising sealing an adhesive strip of the upper flap to an outer surface of the portion.

12. The method of claim 11, further comprising sealing an adhesive strip of the flange to an inner surface of the portion.

13. The method of claim 7, further comprising sealing an adhesive strip of the flange to an inner surface of the portion.

* * * * *